US010895101B1

(12) United States Patent
Johnson et al.

(10) Patent No.: US 10,895,101 B1
(45) Date of Patent: Jan. 19, 2021

(54) ADAPTABLE FENESTRATION FRAME MEMBERS AND METHODS

(71) Applicant: Andersen Corporation, Bayport, MN (US)

(72) Inventors: Craig Johnson, North Oaks, MN (US); Todd Bruchu, Lake Elmo, MN (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 16/800,072

(22) Filed: Feb. 25, 2020

Related U.S. Application Data

(63) Continuation of application No. 15/882,112, filed on Jan. 29, 2018, now Pat. No. 10,604,988.

(60) Provisional application No. 62/452,137, filed on Jan. 30, 2017.

(51) Int. Cl.

| | |
|---|---|
| ***E06B 3/22*** | (2006.01) |
| ***E06B 1/10*** | (2006.01) |
| ***E06B 1/20*** | (2006.01) |
| ***E06B 1/60*** | (2006.01) |

(52) U.S. Cl.
CPC ..... *E06B 3/22* (2013.01); *E06B 1/10* (2013.01); *E06B 1/20* (2013.01); *E06B 1/603* (2013.01)

(58) Field of Classification Search
CPC ..... E06B 1/30; E06B 3/22; E06B 1/10; E06B 1/20; E06B 1/603
See application file for complete search history.

(56) References Cited

U.S. PATENT DOCUMENTS

| | | | | |
|---|---|---|---|---|
| 4,259,813 | A | 4/1981 | Winner | |
| 4,694,552 | A * | 9/1987 | Ecker | E06B 3/26341 29/418 |
| 4,831,781 | A | 5/1989 | Morton | |
| 4,856,239 | A * | 8/1989 | Elsasser | E06B 1/30 52/98 |
| 4,941,288 | A | 7/1990 | Morton | |
| 5,157,881 | A | 10/1992 | Tashman et al. | |
| 5,293,723 | A * | 3/1994 | Slessor | E06B 1/30 49/380 |
| 5,497,594 | A | 3/1996 | Guiseppe et al. | |
| 5,585,155 | A | 12/1996 | Heikkila et al. | |
| 5,622,017 | A | 4/1997 | Lynn et al. | |
| 5,687,519 | A | 11/1997 | Bruchu | |
| 5,713,159 | A | 2/1998 | Schmidt | |
| 5,791,104 | A * | 8/1998 | Baier | E06B 1/342 49/505 |
| 6,106,944 | A | 8/2000 | Heikkila et al. | |
| 6,210,792 | B1 | 4/2001 | Seethamraju et al. | |
| 6,260,251 | B1 * | 7/2001 | Guhl | E06B 3/08 29/412 |
| 6,280,667 | B1 | 8/2001 | Koenig et al. | |

(Continued)

*Primary Examiner* — Andrew J Triggs
(74) *Attorney, Agent, or Firm* — Mueting Raasch Group

(57) ABSTRACT

Adaptable fenestration frame members, fenestration units using the frame members, and methods of adapting the fenestration frame members. The adaptable fenestration frame members provide a construction that is adaptable for use in both pocket and non-pocket installations by including an adaptation channel forming an outside corner along one edge of the fenestration frame member. Removal of the outside corner converts that portion of the frame member from an outside corner to an inside corner, thus adapting the frame member for use in a pocket installation.

15 Claims, 6 Drawing Sheets

(56) References Cited

U.S. PATENT DOCUMENTS

| | | | | |
|---|---|---|---|---|
| 6,342,172 | B1 | 1/2002 | Finley | |
| 6,427,398 | B1 * | 8/2002 | Levine | E06B 1/28 52/100 |
| 6,530,183 | B1 | 3/2003 | Kuei-Yung | |
| 6,680,090 | B2 | 1/2004 | Godavarti et al. | |
| 6,904,726 | B2 * | 6/2005 | Heard | E06B 1/6015 49/504 |
| 6,966,158 | B1 * | 11/2005 | Christensen | E06B 3/22 49/504 |
| 7,013,603 | B2 | 3/2006 | Eenigenburg et al. | |
| 7,533,503 | B2 | 5/2009 | Wang | |
| 7,905,058 | B2 | 3/2011 | Massey | |
| 8,176,680 | B2 * | 5/2012 | Chubb | E05D 15/0621 49/425 |
| 8,522,479 | B2 | 9/2013 | Massey | |
| 2007/0277455 | A1 | 12/2007 | Flanigan et al. | |
| 2013/0111847 | A1 | 5/2013 | Emanuel | |
| 2015/0308181 | A1 | 10/2015 | Wagner | |
| 2017/0240738 | A1 | 8/2017 | Ehrlichmann et al. | |
| 2018/0106095 | A1 | 4/2018 | Seiling | |

* cited by examiner

ADAPTABLE FENESTRATION FRAME MEMBERS AND METHODS

RELATED APPLICATION

This application is a continuation application of U.S. patent application Ser. No. 15/882,112, filed Jan. 29, 2018, which claims the benefit under 35 U.S.C. Section 119 of U.S. Provisional Patent Application Ser. No. 62/452,137 entitled "ADAPTABLE FENESTRATION FRAME MEMBERS AND METHODS" and filed on Jan. 30, 2017, which are incorporated herein by reference in their entireties.

This invention relates to adaptable fenestration frame members, fenestration units using the frame members, and methods of adapting the fenestration frame members for installation in different building openings.

A variety of fenestration units are manufactured using frame members which are extruded into frame members needed to form the various components of the fenestration unit such as, e.g., side jambs and/or head jambs. The frame members may be manufactured by a variety of processes. The frame members may be manufactured in a continuous process (e.g., through extrusion, pultrusion, etc.) of one or more polymers and, optionally, one or more fibers, etc. Examples of some potentially suitable materials and methods for such frame members may include those described in, e.g., U.S. Pat. No. 5,497,594 (Guiseppe et al.); U.S. Pat. No. 5,585,155 (Heikkila et al.); U.S. Pat. No. 6,106,944 (Heikkila et al.); U.S. Pat. No. 6,210,792 Seethamraju et al.); U.S. Pat. No. 6,260,251 (Guhl); U.S. Pat. No. 6,280,667 (Koenig et al.); U.S. Pat. No. 6,342,172 (Finley); U.S. Pat. No. 6,680,090 (Godavarti et al.); etc.

Fenestration units manufactured with frame members that may be manufactured using such processes are described in, e.g., U.S. Pat. No. 5,622,017 (Lynn et al.) and U.S. Pat. No. 5,687,519 (Bruchu) along with methods of installing the fenestration units including, in some instances, removing all of the components of an existing fenestration unit from the opening such that the opening includes flat, featureless sides into which a replacement fenestration unit is installed. In other instances, the installation process involves removing only some components while leaving others (e.g., removing sashes, portions or all of one or both blind stops, parting stops, etc.), leaving a pocket in a building opening into which a replacement fenestration unit is to be installed.

SUMMARY

Adaptable fenestration frame members, fenestration units using the frame members, and methods of adapting the fenestration frame members are described herein.

Although fenestration units manufactured using frame members that are extruded, pultruded, etc. are generally economical and durable, installing the fenestration units in differently shaped openings has required the use of frame members having different shapes adapted for installation in the differently shaped openings. For example, the frame members required for a fenestration unit to be installed in a pocket opening have a different shape than the frame members required for a fenestration unit to be installed in an opening that does not include pockets along the sides and top of the opening. As a result, manufacturers are required to maintain larger inventories of frame members having different profiles needed for installation in the differently shaped building openings, thereby increasing their costs and the complexity of the fenestration unit manufacturing processes.

The adaptable fenestration frame members described herein do, however, provide a construction that is adaptable for use in both pocket and non-pocket installations. In particular, the fenestration frame members described herein include a body having an adaptation channel forming an outside corner along one edge of the fenestration frame member. Removal of the walls forming that outside corner converts that portion of the frame member from an outside corner to an inside corner, thus adapting the frame member for use in a pocket installation as described herein. As a result, a manufacturer need only manufacture one universal frame member that can be adapted for both pocket and non-pocket installations.

In a first aspect, one or more embodiments of an adaptable fenestration frame member as described herein that extends along a frame member length includes: a body extending along the frame member length, the body comprising a jamb face and a sash face, wherein the jamb face is configured to face a jamb defining an edge of a building opening in which a fenestration unit including the frame member is installed and the sash face is located opposite the jamb face and configured to face a sash of a fenestration unit including the frame member, the body further comprising a first side and a second side, wherein the first side extends between the jamb face and the sash face and the second side extends between the jamb face and the sash face, and further wherein the first and second sides are located on opposite sides of the frame member such that the first side faces away from the body in a first direction and the second side faces away from the body in a second direction, wherein the first and second directions face in opposite directions from each other; and an adaptation channel extending along the first side of the body between the jamb face and the sash face, wherein the adaptation channel extends over the frame member length. The adaptation channel comprises: a first wall forming a portion of the jamb face; a second wall forming a portion of the first side of the body; an outside corner formed by the first wall and the second wall at a junction between the jamb face and the first side of the body; and an inside corner located within the adaptation channel. Removal of at least a portion of the first wall and at least a portion of the second wall removes the outside corner formed by the first wall and the second wall at the junction between the jamb face and the first side of the body and exposes the inside corner located within the adaptation channel.

In one or more embodiments of an adaptable frame member as described herein, the adaptation channel comprises a generally rectangular inner cross-sectional shape before removal of the outside corner formed by the first wall and the second wall at the junction between the jamb face and the first side of the body.

In one or more embodiments of an adaptable frame member as described herein, the adaptation channel comprises a closed adaptation channel.

In one or more embodiments of an adaptable frame member as described herein, the frame member further comprises an open trim channel extending along the frame member length adjacent the adaptation channel, wherein the trim channel opens in the first direction and is sized and configured to receive and retain a trim member extending along the frame member length before and after removal of the outside corner formed by the first wall and the second wall at the junction between the jamb face and the first side of the body. In one or more embodiments, the trim channel is located between the adaptation channel and the sash face of the body of the frame member.

In one or more embodiments of an adaptable frame member as described herein, the frame member further comprises an extension jamb channel extending along the second side of the body between the jamb face and the sash face, wherein the extension jamb channel extends over the frame member length; and the extension jamb channel comprises a sacrificial wall forming a portion of the second side of the body between the jamb face and the sash face, wherein removal of the sacrificial wall opens the extension jamb channel such that the extension jamb channel is configured to receive a portion of an extension jamb oriented generally parallel with the jamb defining an edge of a building opening in which a fenestration unit including the frame member is installed.

In a second aspect, one or more embodiments of a fenestration unit as described herein that is adaptable from a first configuration suitable for installation in a rough opening to a second configuration suitable for pocket installation within an existing fenestration frame located in a building opening includes: a sash and a frame surrounding the sash, wherein the frame comprises a plurality of frame members connected to form the frame, wherein the plurality of frame members comprises a left frame member and a right frame member located on opposite sides of the sash. Each of the left frame member and the right frame member comprise: a body extending along a frame member length, the body comprising a jamb face and a sash face, wherein the jamb face is configured to face a jamb defining an edge of a building opening in which the fenestration unit is installed and the sash face is located opposite the jamb face and configured to face the sash of the fenestration unit, the body further comprising a first side and a second side, wherein the first side extends between the jamb face and the sash face and the second side extends between the jamb face and the sash face, and further wherein the first and second sides are located on opposite sides of the frame member such that the first side faces away from the building opening in a first direction and the second side faces away from the building opening in a second direction, wherein the first and second directions face in opposite directions from each other; and an adaptation channel extending along the first side of the body between the jamb face and the sash face, wherein the adaptation channel extends over the frame member length. The adaptation channel comprises: a first wall forming a portion of the jamb face; a second wall forming a portion of the first side of the body; an outside corner formed by the first wall and the second wall at a junction between the jamb face and the first side of the body; and an inside corner located within the adaptation channel, Removal of at least a portion of the first wall and at least a portion of the second wall removes the outside corner formed by the first wall and the second wall at the junction between the jamb face and the first side of the body and exposes the inside corner located within the adaptation channel such that the fenestration unit is adapted from the first configuration suitable for installation within a rough opening to the second configuration suitable for pocket installation within an existing fenestration frame located in a building opening.

In one or more embodiments of a fenestration unit as described herein, the adaptation channel in each of the left frame member and the right frame member comprises a generally rectangular inner cross-sectional shape before removal of the outside corner formed by the first wall and the second wall at the junction between the jamb face and the first side of the body.

In one or more embodiments of a fenestration unit as described herein, the adaptation channel in each of the left frame member and the right frame member comprises a closed adaptation channel.

In one or more embodiments of a fenestration unit as described herein, each of the left frame member and the right frame member further comprises an open trim channel extending along the frame member length adjacent the adaptation channel, wherein the trim channel opens in the first direction and is sized and configured to receive and retain a trim member extending along the frame member length before and after removal of the outside corner formed by the first wall and the second wall at the junction between the jamb face and the first side of the body. In one or more embodiments, the trim channel is located between the adaptation channel and the sash face of the body of each of the left frame member and the right frame member.

In one or more embodiments of a fenestration unit as described herein, each of the left frame member and the right frame member further comprises an extension jamb channel extending along the second side of the body between the jamb face and the sash face, wherein the extension jamb channel extends over the frame member length; and the extension jamb channel comprises a sacrificial wall forming a portion of the second side of the body between the jamb face and the sash face, wherein removal of the sacrificial wall opens the extension jamb channel such that the extension jamb channel is configured to receive a portion of an extension jamb oriented generally parallel with the jamb defining an edge of a building opening in which the fenestration unit is installed.

In a third aspect, one or more embodiments of a method of adapting a frame member of a fenestration unit from a first configuration suitable for installation in a rough opening to a second configuration suitable for pocket installation within an existing fenestration frame located in a building opening includes: providing a fenestration frame member extending along a frame member length, the frame member comprising: a body extending along the frame member length, the body comprising a jamb face and a sash face, wherein the jamb face is configured to face a jamb defining an edge of a building opening in which a fenestration unit including the fenestration frame member is installed and the sash face is located opposite the jamb face and configured to face a sash of a fenestration unit including the fenestration frame member, the body further comprising a first side and a second side, wherein the first side extends between the jamb face and the sash face and the second side extends between the jamb face and the sash face, and further wherein the first and second sides are located on opposite sides of the frame member such that the first side faces away from the building opening in a first direction and the second side faces away from the building opening in a second direction, wherein the first and second directions face in opposite directions from each other. The fenestration frame member further includes an adaptation channel extending along the first side of the body between the jamb face and the sash face, wherein the adaptation channel extends over the frame member length, wherein the adaptation channel comprises: a first wall forming a portion of the jamb face; a second wall forming a portion of the first side of the body; an outside corner formed by the first wall and the second wall at a junction between the jamb face and the first side of the body; and an inside corner located within the adaptation channel. The method further includes removing the outside corner of the adaptation channel and expose the inside corner located within the adaptation channel.

In one or more embodiments of the methods of adapting a frame member of a fenestration unit as described herein, removing the outside corner of the adaptation channel comprises removing at least a portion of the first wall and at least a portion of the second wall at the junction between the jamb face and the first side of the body. In one or more embodiments, removing at least a portion of the first wall and at least a portion of the second wall comprises removing at least a portion of the first wall and at least a portion of the second wall along the entire frame member length of the frame member.

In one or more embodiments of the methods of adapting a frame member of a fenestration unit as described herein, the adaptation channel comprises a generally rectangular inner cross-sectional shape before removing the outside corner of the adaptation channel.

In one or more embodiments of the methods of adapting a frame member of a fenestration unit as described herein, the adaptation channel comprises a closed adaptation channel before removing the outside corner of the adaptation channel.

In one or more embodiments of the methods of adapting a frame member of a fenestration unit as described herein, the frame member further comprises an open trim channel extending along the frame member length adjacent the adaptation channel, wherein the trim channel opens in the first direction and is sized and configured to receive and retain a trim member extending along the frame member length before and after removing at least a portion of the first wall and at least a portion of the second wall. In one or more embodiments, the trim channel is located between the adaptation channel and the sash face of the body of the frame member.

In one or more embodiments of the methods of adapting a frame member of a fenestration unit as described herein, the frame member further comprises an extension jamb channel extending along the second side of the body between the jamb face and the sash face, wherein the extension jamb channel extends over the frame member length and comprises a sacrificial wall forming a portion of the second side of the body between the jamb face and the sash face, and the method further comprises removing at least a portion of the sacrificial wall to open the extension jamb channel such that, after removing at least a portion of the sacrificial wall, the extension jamb channel is configured to receive a portion of an extension jamb oriented generally parallel with the jamb defining an edge of a building opening in which a fenestration unit including the frame member is installed.

Where used herein, the terms "top" and "bottom" are used for reference relative to each other when fenestration units using the adaptable fenestration frame members Where used herein, the terms "exterior" and "interior" are used in a relative sense, e.g., an exterior side and an interior side of an adaptable frame member describe opposite sides of a fenestration system including the adaptable frame member when installed in a building opening. In other words, an exterior side could be found within the interior of a building or other structure that would conventionally define an interior and an exterior, while an interior side could be found outside of a building or other structure that would conventionally define an interior and an exterior. With respect to the illustrative embodiments described herein, the exterior and interior sides of an adaptable frame member would be found on opposite ends along the y-axis of the Cartesian coordinate systems provided in the figures.

The above summary is not intended to describe each embodiment or every implementation of the adaptable fenestration frame members, fenestration units using the frame members, and methods of adapting the fenestration frame members as described herein. Rather, a more complete understanding of the invention will become apparent and appreciated by reference to the following Description of Illustrative Embodiment and claims in view of the accompanying figures of the drawing.

BRIEF DESCRIPTIONS OF THE DRAWING

Figure 1:
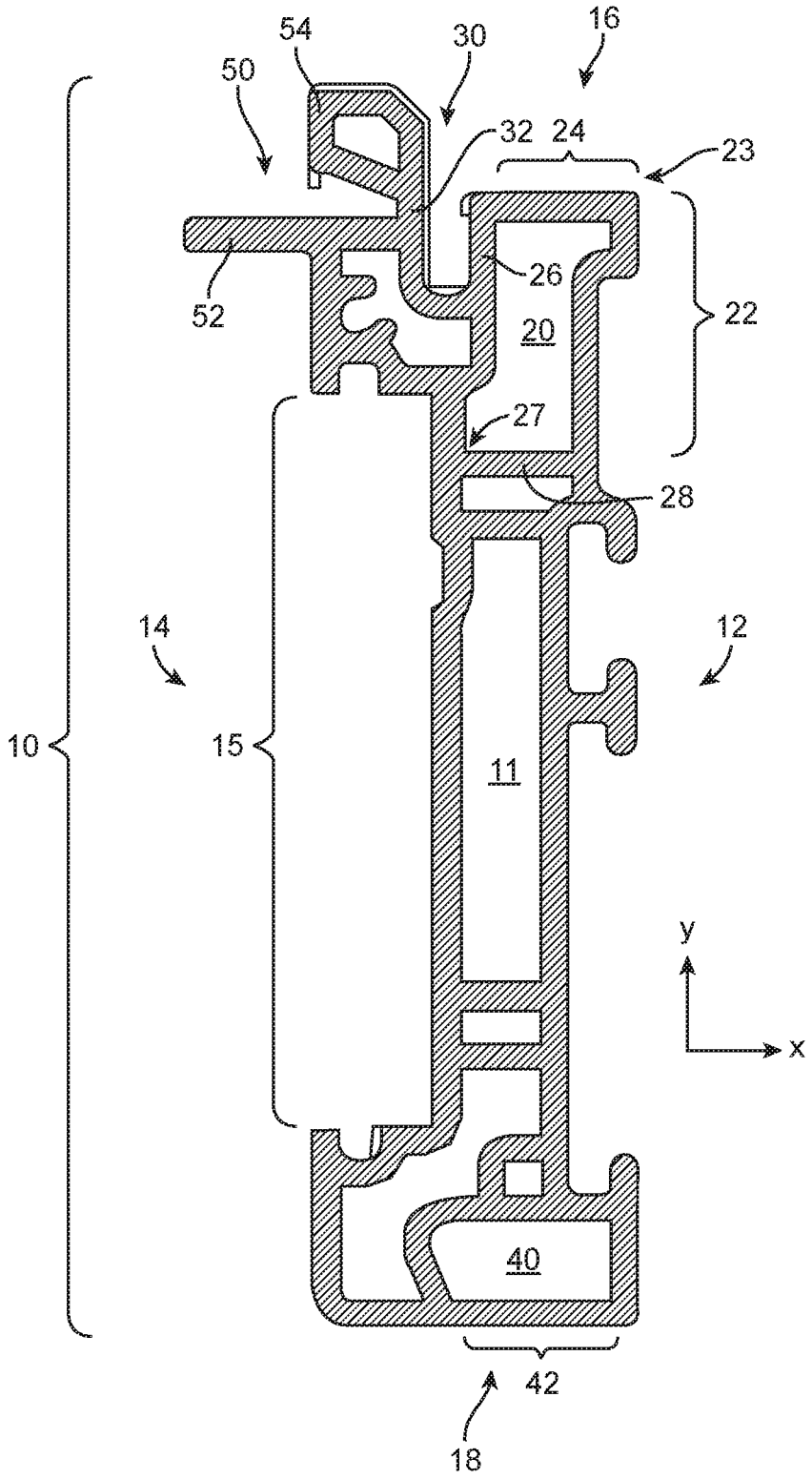
FIG. 1 depicts one illustrative embodiment of an adaptable fenestration frame member as described herein in a cross-sectional view taken transverse to a length of the frame member.

For reference, each of the figures includes Cartesian coordinate system axes to assist in description of the various components of the adaptable fenestration frame members, fenestration units using the frame members, and methods of adapting the fenestration frame members between the different figures as described herein.

DETAILED DESCRIPTION

In the following description, reference is made to the accompanying figures of the drawing which form a part hereof, and in which are shown, by way of illustration, specific embodiments. It is to be understood that other embodiments may be utilized and changes may be made without departing from the scope of the present invention.

One illustrative embodiment of an adaptable frame member for use in manufacturing fenestration units as described herein is depicted in FIG. 1. The frame member 10 is depicted in a cross-sectional view taken transverse to the length of the frame member 10. The cross-sectional view of FIG. 1 is taken in the x-y plane, while the frame member 10 has a length that would extend along the corresponding z-axis.

Generally, the frame member 10 may be described as including a body that extends along the frame member length.

The frame member 10 may include a variety of features such as, cavities, walls, webs, etc. designed to provide structural integrity to the frame member 10 and/or to allow for the connection or interaction of other components with the frame member 10 when incorporated into a fenestration unit as described herein. For example, frame member 10 may include a main cavity 11 occupying a substantial portion of the body of frame member 10 along with other smaller cavities located within the body of frame member 10. The cavities and other internal structures within a frame member 10 may also be provided to improve the manufacturing process, reduce the amount of material needed to form frame member 10, etc. For example, in one or more embodiments, the smaller cavities located on opposite ends of the main cavity 11 may be sized to receive a fastener such as a screw, nail, etc. for use in securing the frame member 10 either to the fenestration unit itself and/or to the side of a building opening in which the fenestration unit is installed. Such features will be known to those skilled in the art and will not be further described herein.

The body of the frame member 10 defines a jamb face 12 and a sash face 14. The jamb face 12 is configured to face a jamb defining an edge of a building opening (sometimes referred to as a rough opening) in which a fenestration unit including the frame member 10 is installed. The sash face 14 is located opposite from the jamb face 12 and is configured to face a sash (or sashes) of a fenestration unit including the frame member 10.

The body of the frame member 10 may further be described as including a first side 16 and a second side 18. The first side 16 extends between the jamb face 12 and the sash face 14, while the second side 18 extends between the jamb face 12 and the sash face 14 on the opposite side of the body of the frame member 10. The first and second sides 16 and 18 are located on opposite sides of the frame member 10 such that the first side 16 faces away from a building opening in a first direction and the second side faces away from the building opening in a second direction, where the first and second directions are opposite from each other and extend along the y-axis as depicted in FIG. 1.

In the depicted illustrative embodiment of frame member 10, the first side 16 of the body of frame member 10 will typically be oriented towards an exterior of a building in which a fenestration unit using the frame member 10 is installed, while the second side 18 of the body of frame member 10 will typically be oriented towards an interior of the building, although such an arrangement is not required.

The depicted illustrative embodiment of frame member 10 also includes a sash liner pocket 15 on the sash face 14 of the body of the frame member 10. The sash liner pocket 15 may, in one or more embodiments, be configured to receive a sash liner of a fenestration unit as described herein. In one or more alternative embodiments, a sash liner may be formed integrally with the frame member, such that a sash liner pocket is not required.

The depicted illustrative embodiment of frame member 10 also includes an adaptation channel 20 that extends along the first side 16 of the body of frame member 10 and is located between the jamb face 12 and the sash face 14. The depicted illustrative embodiment of the adaptation channel 20 extends over the frame member length, i.e., along a z-axis as discussed herein. In one or more embodiments, the adaptation channel 20 preferably extends along the entire length of the body of frame member 10 such that it is coextensive with the frame member 10.

In one or more embodiments, the adaptation channel 20 may be described as a closed adaptation channel which, as used herein, means that the only openings into the adaptation channel are found at the ends of the frame member 10 such that the closed adaptation channel 20 essentially forms a closed, tubular structure along the first side 16 of the body of frame member 10.

The adaptation channel 20, when in its closed configuration as depicted in FIG. 1, includes a first wall 22 that forms a portion of the jamb face 12 of the body of frame member 10. In one or more embodiments, the first wall may be featureless, i.e., flat. In the depicted illustrative embodiment, however, the first wall 22 of the adaptation channel 20 includes a step therein which may be used to mate with other components not shown in FIG. 1.

The adaptation channel 20, in its closed configuration as depicted in FIG. 1, also includes a second wall 24 that forms a portion of the first side 16 of the body of frame member 10. An outside corner 23 is formed by the first wall 22 and the second wall 24 at the junction between the jamb face 12 and the first side 16 of the body of frame member 10.

The adaptation channel 20 includes, in the depicted illustrative embodiment an inside corner 27 located within the adaptation channel 20. In the depicted embodiment, the inside corner 27 is formed at a junction between interior walls 26 and 28 which also define the boundaries of the adaptation channel 20.

In one or more embodiments, and adaptation channel such as the depicted illustrative embodiment of adaptation channel 20 may have a generally rectangular inner cross-sectional shape before removal of the outside corner 23 formed by the first wall 22 and the second wall 24 at the junction between the jamb face 12 and the first side 16 of the body of frame member 10.

Removal of at least a portion of the first wall 22 and at least a portion of the second wall 24 forming the adaptation channel 20 removes the outside corner 23 at the junction between the jamb face 12 and the first side 16 of the body of frame member 10 and, further, exposes the inside corner 27 located within the adaptation channel 20. Removal of the outside corner 23 and exposure of the inside corner 27 forms a notch in the body of the frame member 10 at the junction between the jamb face 12 and the first side 16, with that notch being useful for adapting the frame member 10 for use in a pocket type installation as will be described herein.

Another optional feature which may be found in one or more embodiments of frame members as described herein include an open trim channel 30 which opens towards the first side 16 of the body of frame member 10 and extends along the frame member length adjacent to the adaptation channel 20. In one or more embodiments, the trim channel 30 preferably is coextensive with the body of frame member 10. In one or more embodiments, the trim channel 30 may be described as opening in the first direction along with the first side 16 of the body of frame member 10. In one or more embodiments, the trim channel 30 is sized and configured to receive and retain a trim member that may also extend along the frame member length both before and after removal of the outside corner 23 formed by the first wall 22 and the second wall 24 at the junction between the jamb face 12 and the first side 16 of the body of frame member 10.

In one or more embodiments of a frame member as described herein, the trim channel 30 may be described as being located between the adaptation channel 20 and the sash face 14 of the body of frame member 10. As a result, removal of the outside corner 23 and the walls of the adaptation channel 20 forming that outside corner 23, does not adversely impact the integrity of the trim channel 30. In the depicted illustrative embodiment, the trim channel 30 is defined by interior wall 26 forming a portion of the adaptation channel 20 as well as wall 32 located opposite from interior wall 26, with the trim channel 30 being located between wall 32 and interior wall 26.

The depicted illustrative embodiment of frame member 10 also includes a closed extension jamb channel 40 that extends along the second side 18 of the body of frame member 10. The closed extension jamb channel 40 may, in one or more embodiments, be coextensive with the length of the frame member 10. In one or more embodiments, the extension jamb channel 40 includes a sacrificial wall 42 that, in the depicted embodiment, forms a portion of the second side 18 of the body of frame member 10 between the jamb face 12 and the sash face 14. Removal of the sacrificial wall 42 opens the extension jamb channel 40 such that the extension jamb channel 40 is configured to receive a portion of an extension jamb as will be described herein. Generally, any such extension jamb may be described as oriented generally parallel with a jamb defining an edge of a building opening in which the fenestration unit including frame member 10 is installed.

Another optional feature included in the depicted illustrative embodiment of frame member 10 as seen in FIG. 1 is a screen frame retaining channel 50 including an interior stop 52 and an exterior stop 54 forming an inside corner configured to receive a frame of a screen unit attached to the fenestration unit in which frame member 10 is used.

As discussed herein, the adaptable frame members for fenestration units may be used to reduce inventory by providing a common profile that may be used to manufacture fenestration units configured for installation in building openings that have different shapes or profiles. In particular, the adaptable frame members described herein, while designed for installation in a building opening having flat surfaces (such as, e.g., conventional rough openings into which fenestration units may be installed), may be easily adapted for use in a pocket type installation in which a pocket is formed along the left and right sides and, typically, the header or top of the building opening.

Figure 2:
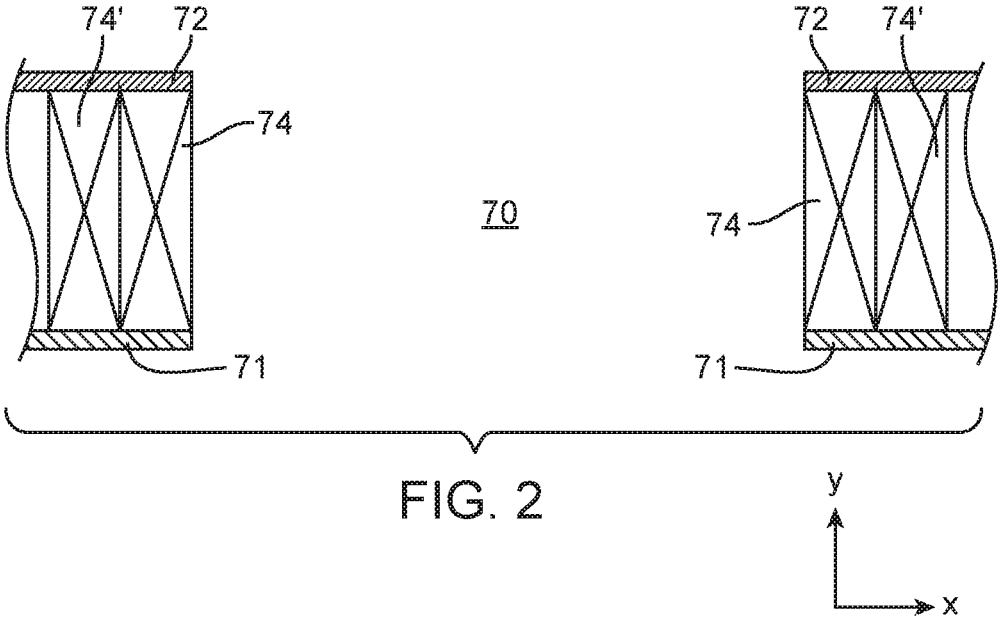
FIG. 2 is a cross-sectional view of a building opening in the form of a rough opening in which fenestration unit is to be installed.
Figure 3:
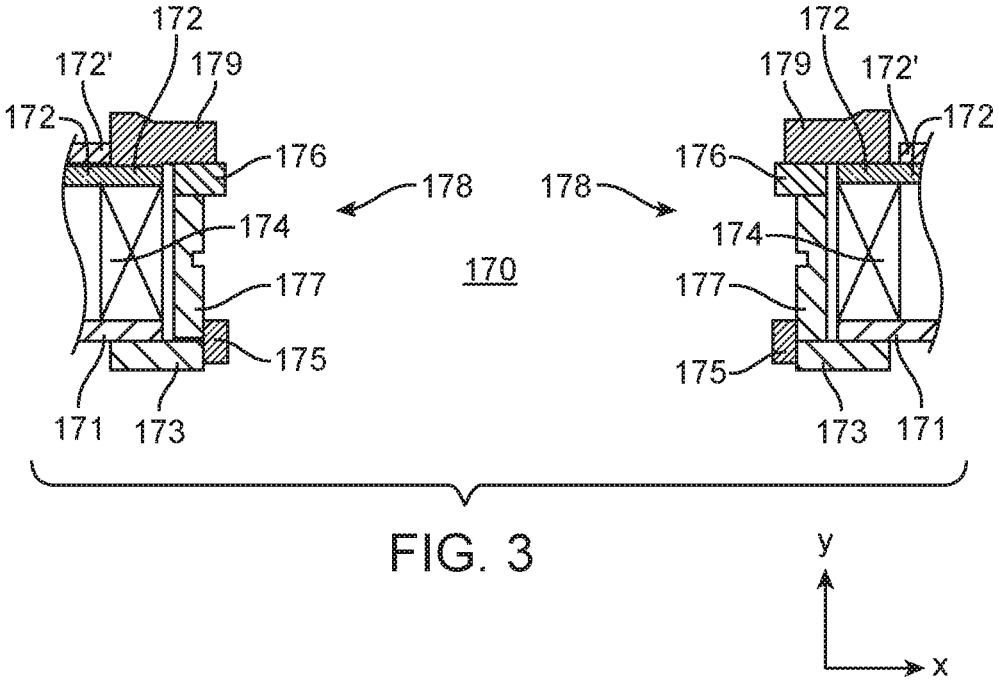
FIG. 3 is a cross-sectional view of a building opening in the form of a pocket opening in which the sashes and parting stops of an old window have been removed while leaving the pocket portion of the old window in the opening.

Two building openings having different edge profiles are depicted in cross-section views in FIGS. 2 and 3. In particular, FIG. 2 depicts a building opening 70 in the form of a rough opening. Building openings in the form of rough openings having flat, featureless surfaces such as those depicted in FIG. 2 may be found in, e.g., new construction, as well as in window replacement situations in which the entire original window is removed to expose the structural members forming the rough opening in which the original window was installed. Although the rough opening depicted in FIG. 2 is in wood frame construction, it should be understood that fenestration units as described herein may also be installed in rough openings in buildings constructed by other techniques (e.g., masonry, etc.) that may also provide relatively flat, featureless openings that do not include a pocket formed by a previous window frame that remains after removal of that window (e.g., as depicted in FIG. 3)

The rough opening 70 depicted in FIG. 2 is defined by structural members 74 extending along and defining the left and right sides of the rough opening 70. The structural members 74 may typically be described as left and right jack studs (sometimes referred to as trimmer studs), which are located inward of king studs 74'. Jack studs 74 typically extend from a window sill plate at a bottom of the rough opening 70 to a header at the top of the rough opening 70 or from the sole or bottom plate located on a floor below the rough opening 70 to the header. King studs 74' typically extend from a sole or bottom plate located on the floor below the rough opening to a top plate located above the header. Typically, the header and window sill plate have a flat, featureless profile facing the rough opening 70 similar to the flat, featureless profile of the jack studs 74 depicted in FIG. 2.

Also depicted in FIG. 2 are sheet materials 71 and 72 provided on opposite sides of the structural member 74. In one or more embodiments, sheet materials 71 may be provided in the form of drywall or other materials commonly used on the interior of a building, while sheet material 72 may be provided in the form of sheathing (e.g., plywood, chipboard, fiberboard, etc.) over which siding or other exterior finish materials are applied.

FIG. 3 is a cross-sectional view of a building opening 170 in the form of a pocket opening in which the sashes of an old window have been removed while leaving the pockets 178 formed by the frame of the old window in the opening. The pockets 178 are formed by the jamb 177 along with stops 175 and 176 of the old window frame. Although not depicted in FIG. 3, a building opening including pockets 178 such as building opening 170 may include a head jamb also forming a pocket between the stops 175 and 176 along the top of the building opening 170. In the depicted illustrative embodiment of building opening 170, exterior sheet material 172 is covered by siding 172' (it being noted that exterior sheet material 72 depicted in FIG. 2 would also typically be covered by siding or other exterior finish materials as well as include trim pieces such as exterior trim pieces 179 seen in FIG. 3).

The existing window sashes are typically removed from the window frame as seen in FIG. 3 by removing the molding and stoop 175 or 176 on only one side of the window. In an exterior approach, the exterior stop 176 (sometimes referred to as the blind stop) can be removed in order to gain sufficient access to the sashes and other components of the old window from the exterior of the building. Removal of the exterior stop 176 may involve intact removal of the stop 176 or, in some instances, may involve cutting or trimming the exterior stop 176 such that it is flush (in the x-direction) with the jamb 177 of the old window frame. If present, a parting stop (not shown) may also need to be removed from the jamb 177. In this exterior approach, the interior trim pieces 173 and interior stop 175 are typically left intact, along with jambs 177 attached to the jack studs 174 defining the left and right sides of the building opening 170. The new fenestration unit, including adaptable frame members along the side jambs and typically the top or head jamb, would then be inserted into the pocket opening from the exterior side of the opening 170.

The frame members of fenestration units installed in building opening 170 from the exterior side typically rest against the stops 175 while exterior stops 176 may or may not be replaced. In those installations in which no exterior stop 176 is replaced after locating the fenestration unit in the opening 170, the adaptation channel of a frame member of the installed fenestration unit as described herein may remain intact.

As an alternative to an exterior installation approach, the interior stop 175 and the interior trim piece 173 (typically casing) may be removed to allow for installation of the fenestration unit without removing the exterior stop 176. If present, parting stops may also be removed, leaving the jambs 177 and exterior stops 176 in position. After placement of a fenestration unit in the opening 170 such that the frame members of the fenestration unit are located adjacent the jambs 177, the interior stop 175 may be replaced along with the trim piece 173 (if the trim piece 173 was removed).

In those installations in which the stop 176 is left intact, the adaptable frame members described herein may be modified or adapted to allow for placement of the outermost frame member of a fenestration unit in the pocket 178. That modification may involve removal of at least a portion of the walls forming an outside corner of an adaptable frame member as described herein, such that the stop 176 can occupy a portion of the adaptation channel in the frame member.

Figure 4:
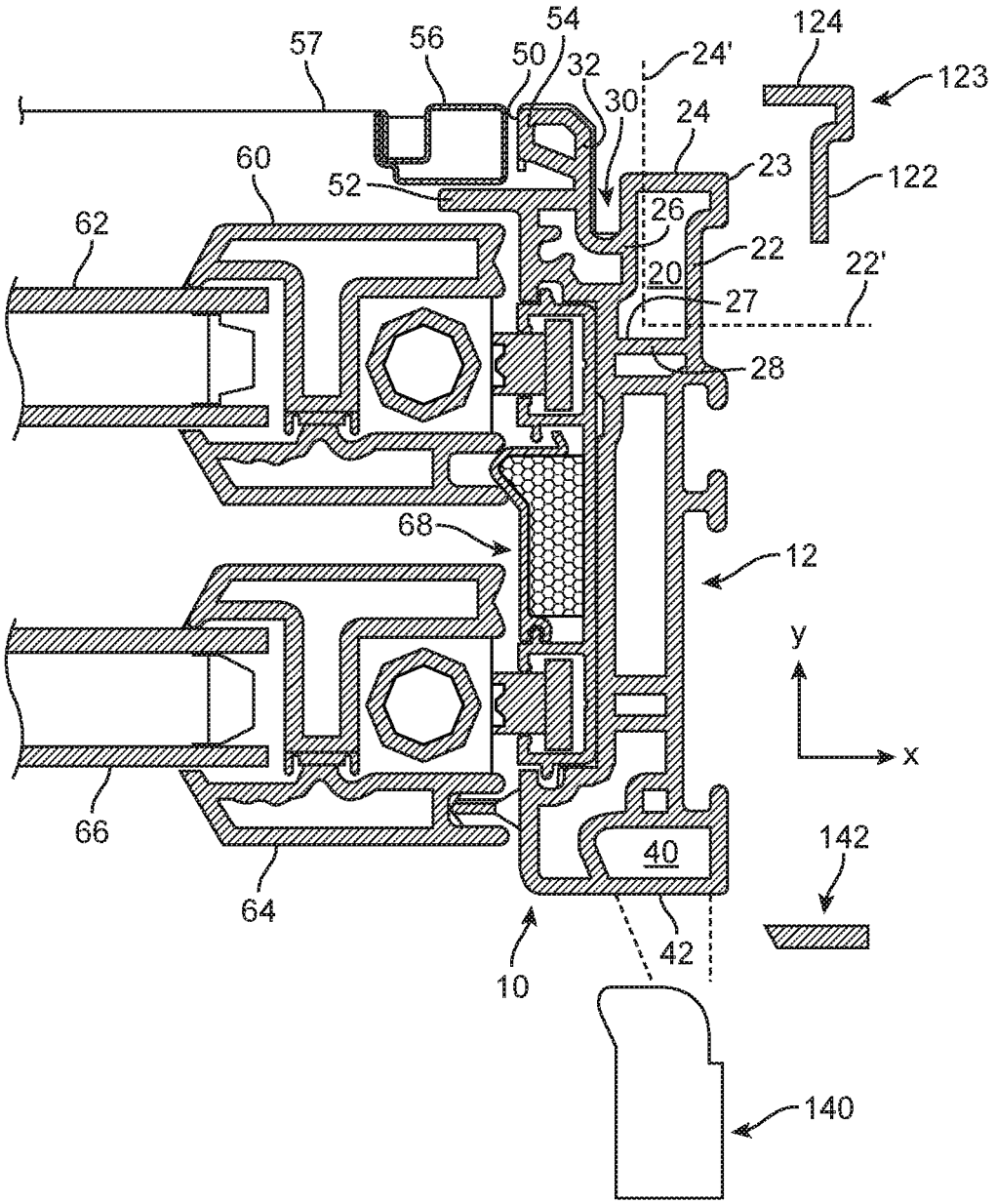
FIG. 4 is a cross-sectional view of the adaptable fenestration frame member of FIG. 1 in combination with upper and lower sashes and a sash liner located in a liner pocket of the frame member of FIG. 1.

A cross-sectional view of one illustrative embodiment of an adaptable frame member 10 as described herein along with the other components of a fenestration unit incorporating the adaptable frame member 10 is depicted in FIG. 4. The fenestration unit components depicted in FIG. 4 will typically be found in a double hung window. The adaptable frame members described herein may, however, be used in many other fenestration units including, but not limited to, casement windows, picture windows, glider windows, awning windows, doors, etc.

The portion of the fenestration unit incorporating adaptable frame member 10 includes a pair of sashes, with a stile 60 and glazing unit 62 of a first sash being depicted in combination with a stile 64 and corresponding glazing unit 66 of a second sash. Both the first and second sashes are connected to a sash liner 68 which is, in the depicted embodiment, located within liner pocket 15 (see, e.g., FIG. 1) of frame member 10. Although the depicted embodiment of a fenestration unit includes a separate sash liner 68 in a sash liner pocket 15, in one or more alternative embodiments, a sash liner may be formed integrally with the frame member, such that a separate sash liner 68 and sash liner pocket 15 are not required.

Many other conventional features of the fenestration unit are also depicted in the cross-sectional view of FIG. 4 such as, e.g., balance units, weatherstripping, etc. Also depicted in the portion of the fenestration unit seen in FIG. 4 is a frame member 56 along with screen 57 of a screen unit that may also be attached to the fenestration unit.

In addition to depicting components of one illustrative embodiment of a fenestration unit in which the illustrative embodiment of adaptable frame member 10 may be used, FIG. 4 also depicts portions of the adaptable frame member 10 that may be removed to allow for conversion of the adaptable frame member 10 from a non-pocket type installation to a pocket type installation. In particular, outside corner portion 123 including a portion 122 of first wall 22 and a portion 124 of second wall 24 of the adaptation channel 20 is depicted in FIG. 4 after removal along lines 22' and 24'.

Removal of the outside corner portion 123 of the adaptation channel 20 will, as described herein, expose inside corner 27 in adaptation channel 20 to allow the jamb face 12 of adaptable frame member 10 to be positioned within a pocket in a building opening as described herein. Lines 22' and 24' along which the outside corner portion 123 of adaptable frame member 10 is removed are illustrative examples and more or less of the first wall 22 and/or second wall 24 may be removed to open the adaptation channel 22 convert frame member 10 for use in a pocket type installation. Suitable techniques for removing the outside corner portion 123 of the adaptation channel 20 will depend on the composition of the adaptable frame member 10, but may include, e.g., routing, grinding, cutting, etc.

Also depicted in connection with FIG. 4 is removal of the sacrificial wall 42 of the extension jamb channel 40, with the removed portion 142 being depicted in FIG. 4, along with one illustrative embodiment of an extension jamb 140, a portion of which may be located within the extension jamb channel 40 after removal of sacrificial wall 42. Suitable techniques for removing the sacrificial wall 42 of the extension jamb channel 40 will, again, depend on the composition of the adaptable frame member 10, but may include, e.g., routing, grinding, cutting, etc.

Figure 5:
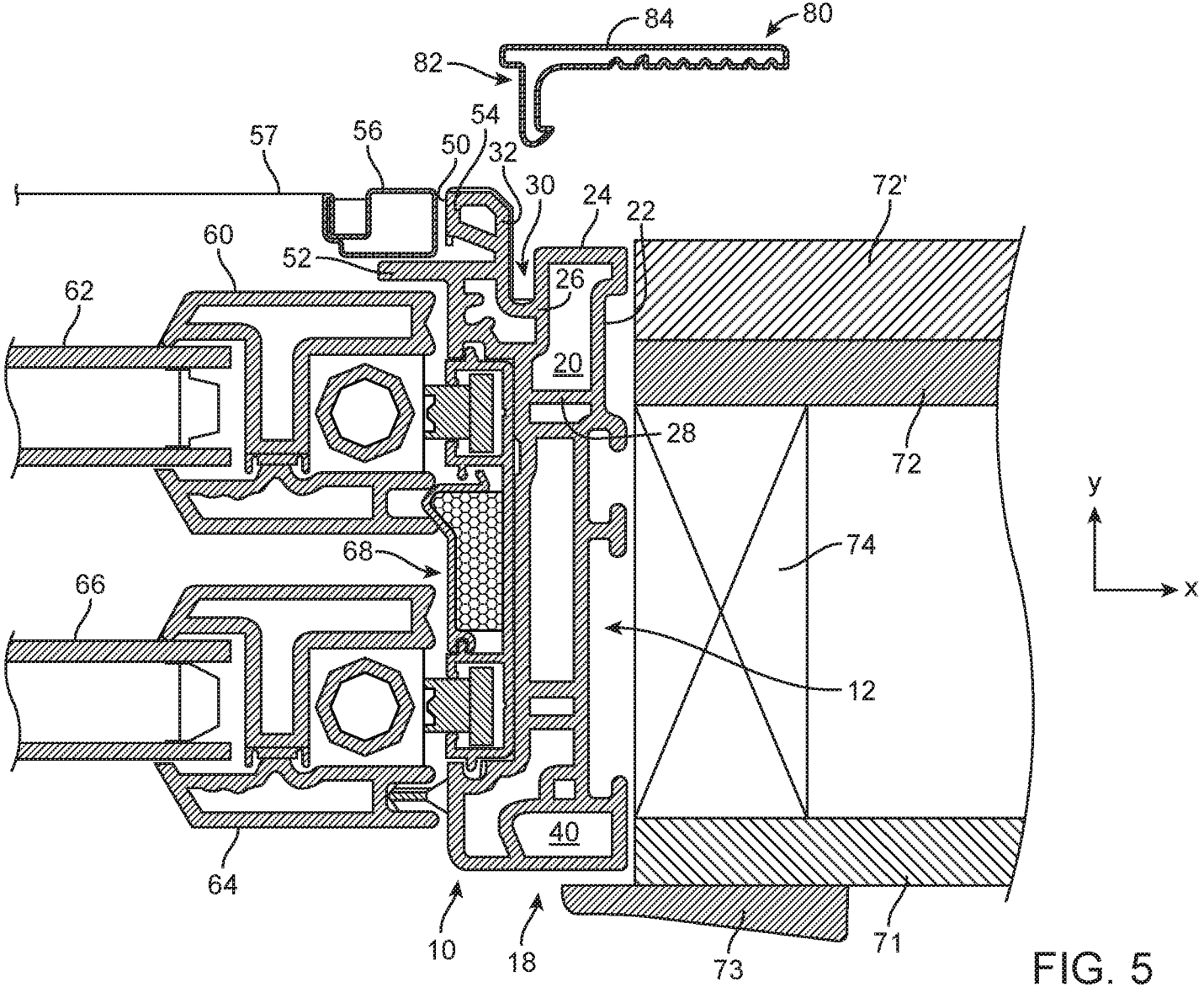
FIG. 5 is an enlarged cross-sectional view of one side of the building opening depicted in FIG. 2 during installation of a fenestration unit including an adaptable frame member as depicted in FIG. 4.

FIG. 5 is an enlarged cross-sectional view of one side of the building opening depicted in FIG. 2 during installation of a fenestration unit including an adaptable frame member as depicted in FIG. 4. In particular, the jamb face 12 of adaptable frame member 10 is shown as installed in the building opening such that the jamb face 12 faces the trimmer or jack stud 74. The fenestration unit as depicted in FIG. 5 may be secured within the rough opening by any suitable technique or combination of techniques, e.g., mechanical fasteners (e.g., screws, nails, rivets, etc.), adhesives, trim pieces, stops, etc.

The first side of the body of frame member 10 is, in the illustrative embodiment of FIG. 5, depicted as being flush with the exterior casing material 72' provided over sheet material 72 about the periphery of the rough opening. In addition, a trim piece 80 is depicted in FIG. 5 including a face piece 84 and an attachment leg 82. Attachment leg 82 is, in the depicted illustrative embodiment, configured to be inserted into trim channel 30 in frame member 10 such that trim piece 80 is retained in position on the fenestration unit. Face piece 84 is, in one or more embodiments, preferably sufficiently large to cover the gap formed between frame member 10 and exterior casing material 72' on that side of the fenestration unit. The depicted trim piece 80 is only one illustrative example of potential trim pieces that could be used in connection with fenestration units that incorporate adaptable frame members as described herein. Furthermore, additional trim pieces may be applied after trim piece 80 such as, e.g., brick molding, etc.

The second side 18 of the body of adaptable frame member 10 is depicted as being generally aligned with the drywall or other interior finish sheet material 71, with any gap between sheet material 71 and frame member 10 being covered by trim piece 73 which, in the depicted illustrative embodiment, is in the form of casing.

Figure 6:
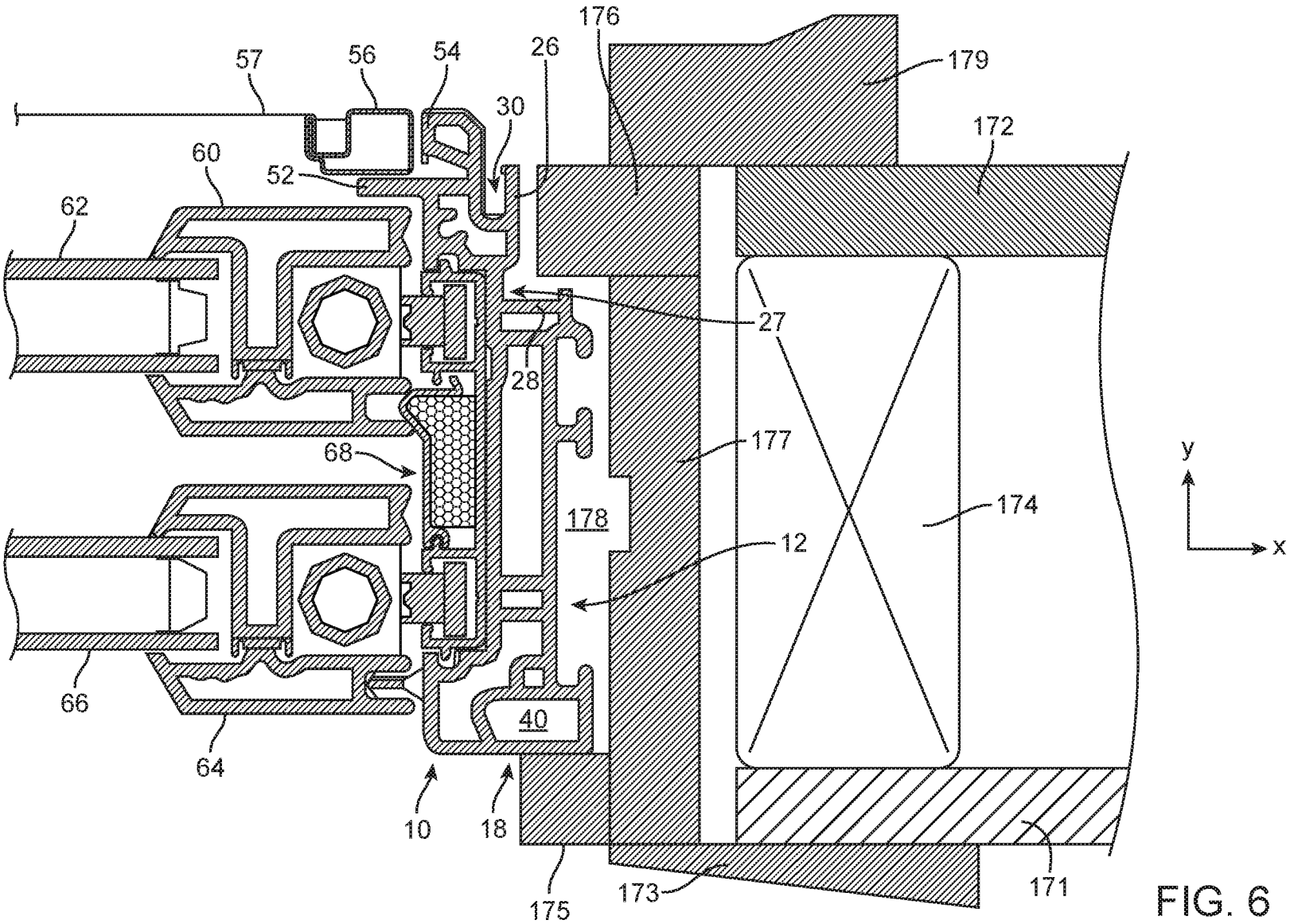
FIG. 6 is an enlarged cross-sectional view of one side of the building opening depicted in FIG. 3 after installation of a fenestration unit including an adaptable frame member as depicted in FIG. 4.

FIG. 6 is an enlarged cross-sectional view of one side of the building opening depicted in FIG. 3 after installation of a fenestration unit including an adaptable frame member as depicted in FIG. 4. The fenestration unit as depicted in FIG. 6 may be secured within the opening by any suitable technique or combination of techniques, e.g., mechanical fasteners (e.g., screws, nails, rivets, etc.), adhesives, trim pieces, stops, etc.

In particular, the frame member 10 as depicted in FIG. 6 has been converted for positioning in pocket 178 formed between stops 175 and 176 and jamb 177. As depicted, the sash face 12 of frame member 10 faces jamb 177, while adaptation channel 20 receives a portion of stop 176 to assist in retaining frame member 10 within pocket 178. Adaptation channel 20 is capable of receiving stop 176 because the outside corner formed on that side of frame member 10 has been removed as described above in connection with, e.g., FIG. 4.

In the depicted installation, the fenestration unit including frame member 10 could be installed in the depicted building opening after removing both brick mold 179 and all or a portion of stop 176, allowing an installer to slide fenestration unit into the building opening such that the frame member 10 is positioned with its jamb face against jamb 177. After securing the fenestration unit in place, stop 176 may be re-secured, along with brick mold 179. Alternatively, however, the fenestration unit could be installed from the opposite side through removal of stop 175. Although not depicted in FIG. 6, a trim piece may be provided and secured using, e.g., trim channel 30 to cover any gap formed between frame member 10 and stop 176.

Alternatively, the fenestration unit including frame member 10 could be installed in the depicted building opening after removing only the stop 175, allowing an installer to slide the fenestration unit into the building opening such that the frame member 10 is positioned with its jamb face 12 against jamb 177. After securing the fenestration unit in place, stop 175 may be re-secured.

Removal of the outside corner of a frame member of a fenestration unit as described herein may, in one or more embodiments, occur before assembly of the frame members into a frame for a fenestration unit for those instances in which the fenestration unit is specifically being manufactured for installation in a building opening having a pocket as described herein. Alternatively, however, fenestration units including an adaptation channel as described herein on their frame members may be adapted after assembly of the fenestration unit for use in a pocket type installation.

Figure 7:
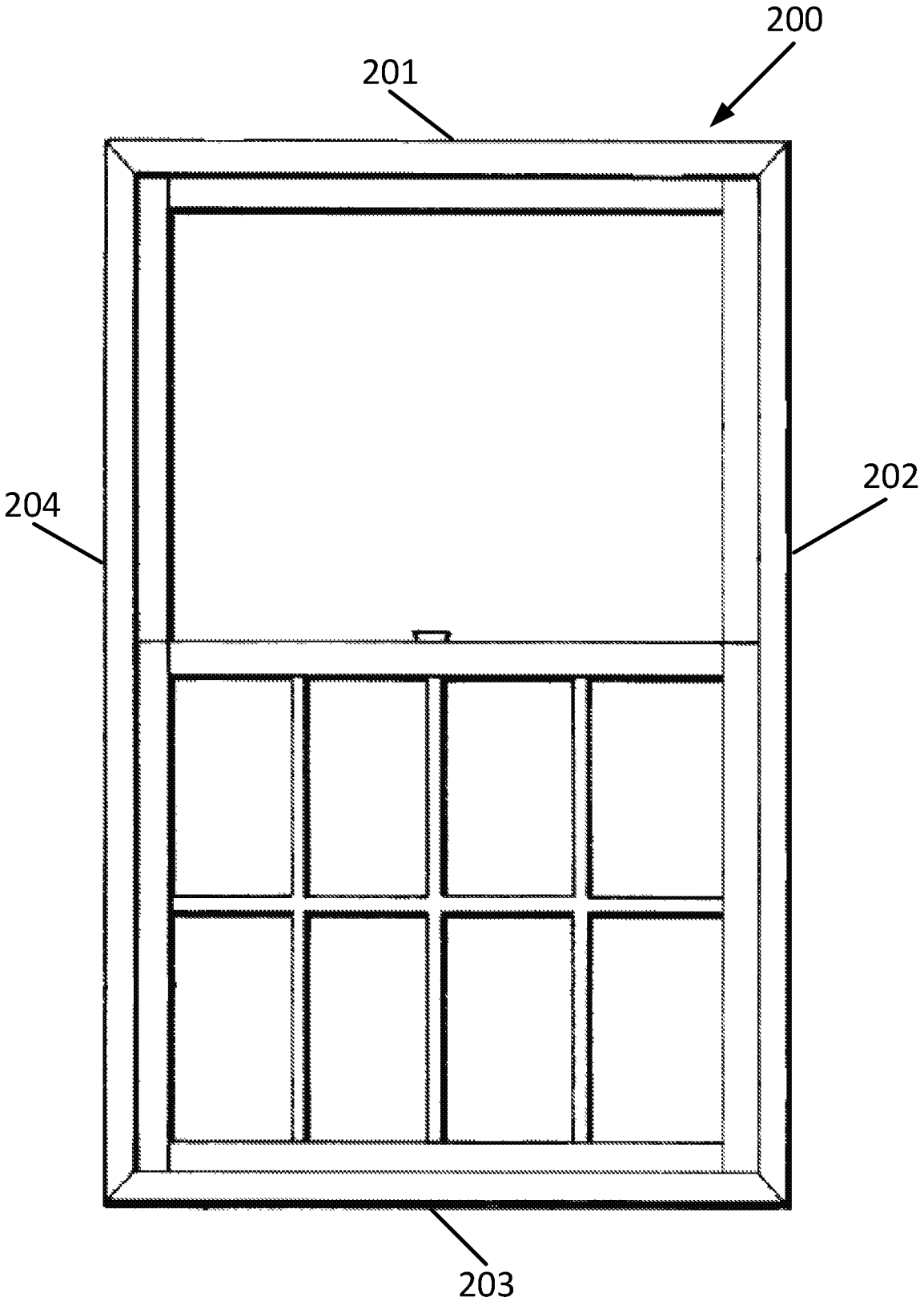
FIG. 7 is a front view of one illustrative embodiment of a fenestration unit including two frame members as described herein.

Regardless of when or where assembled, FIG. 7 depicts one illustrative embodiment of a fenestration unit 200 including four frame members 201-204 that are secured end to one another to form the fenestration unit frame of fenestration unit 200. In one or more embodiments, each of the four frame members 201-204 may be a frame member as described herein.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a system or method that "comprises" a list of elements (e.g., components or features or steps) is not necessarily limited to only those elements (or components or features or steps), but may include other elements (or components or features or steps) not expressly listed or inherent to the method.

As used herein, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

Further, the term "comprises" and variations thereof do not have a limiting meaning where these terms appear in the accompanying description. Moreover, "a," "an," "the," "at least one," and "one or more" are used interchangeably herein.

The complete disclosure of the patents, patent documents, and publications identified herein are incorporated by reference in their entirety as if each were individually incorporated. To the extent there is a conflict or discrepancy between this document and the disclosure in any such incorporated document, this document will control.

From the above disclosure of the general principles of the present invention and the preceding detailed description, those skilled in this art will readily comprehend the various modifications, re-arrangements and substitutions to which the present invention is susceptible, as well as the various advantages and benefits the present invention may provide. Therefore, the scope of the invention should be limited only by the following claims and equivalents thereof. In addition, it is understood to be within the scope of the present invention that the disclosed and claimed articles and methods may be useful in applications other than surgical procedures. Therefore, the scope of the invention may be broadened to include the use of the claimed and disclosed methods for such other applications.

The invention claimed is:

1. A method of adapting a frame member of a fenestration unit from a first configuration suitable for installation in a rough opening to a second configuration suitable for pocket installation within an existing fenestration frame located in a building opening, the method comprising:

providing a fenestration frame member extending along a frame member length, the frame member comprising:

a body extending along the frame member length, the body comprising a jamb face and a sash face, wherein the jamb face is configured to face a jamb defining an edge of a building opening in which a fenestration unit including the fenestration frame member is installed and the sash face is located opposite the jamb face and configured to face a sash of a fenestration unit including the fenestration frame member, the body further comprising a first side and a second side, wherein the first side extends between the jamb face and the sash face and the second side extends between the jamb face and the sash face, and further wherein the first and second sides are located on opposite sides of the frame member such that the first side faces away from the building opening in a first direction and the second side faces away from the building opening in a second direction, wherein the first and second directions face in opposite directions from each other; and an adaptation channel extending along the first side of the body between the jamb face and the sash face, wherein the adaptation channel extends over the frame member length, wherein the adaptation channel comprises:

a first wall forming a portion of the jamb face;

a second wall forming a portion of the first side of the body;

an outside corner formed by the first wall and the second wall at a junction between the jamb face and the first side of the body; and an inside corner located within the adaptation channel;

removing the outside corner of the adaptation channel and expose the inside corner located within the adaptation channel, wherein the adaptation channel comprises a closed adaptation channel before removing the outside corner of the adaptation channel.

2. A method according to claim 1, wherein removing the outside corner of the adaptation channel comprises removing at least a portion of the first wall and at least a portion of the second wall at the junction between the jamb face and the first side of the body.

3. A method according to claim 2, wherein removing at least a portion of the first wall and at least a portion of the second wall comprises removing at least a portion of the first wall and at least a portion of the second wall along the entire frame member length of the frame member.

4. A method according to claim 1, wherein the adaptation channel comprises a generally rectangular inner cross-sectional shape before removing the outside corner of the adaptation channel.

5. A method according to claim 1, wherein the frame member further comprises an open trim channel extending along the frame member length adjacent the adaptation channel, wherein the trim channel opens in the first direction and is sized and configured to receive and retain a trim member extending along the frame member length before and after removing at least a portion of the first wall and at least a portion of the second wall.

6. A method according to claim 5, wherein the trim channel is located between the adaptation channel and the sash face of the body of the frame member.

7. A method according to claim 1, wherein the frame member further comprises an extension jamb channel extending along the second side of the body between the jamb face and the sash face, wherein the extension jamb channel extends over the frame member length and comprises a sacrificial wall forming a portion of the second side of the body between the jamb face and the sash face, wherein the method further comprises:

removing at least a portion of the sacrificial wall to open the extension jamb channel such that, after removing at least a portion of the sacrificial wall, the extension jamb channel is configured to receive a portion of an extension jamb oriented generally parallel with the jamb defining an edge of a building opening in which a fenestration unit including the frame member is installed.

8. A method of adapting a frame member of a fenestration unit from a first configuration suitable for installation in a rough opening to a second configuration suitable for pocket installation within an existing fenestration frame located in a building opening, the method comprising:

providing a fenestration frame member extending along a frame member length, the frame member comprising:

a body extending along the frame member length, the body comprising a jamb face and a sash face, wherein the jamb face is configured to face a jamb defining an edge of a building opening in which a fenestration unit including the fenestration frame member is installed and the sash face is located opposite the jamb face and configured to face a sash of a fenestration unit including the fenestration frame member, the body further comprising a first side and a second side, wherein the first side extends between the jamb face and the sash face and the second side extends between the jamb face and the sash face, and further wherein the first and second sides are located on opposite sides of the frame member such that the first side faces away from the building opening in a first direction and the second side faces away from the building opening in a second direction, wherein the first and second directions face in opposite directions from each other; and an adaptation channel extending along the first side of the body between the jamb face and the sash face, wherein the adaptation channel extends over the frame member length, wherein the adaptation channel comprises:

a first wall forming a portion of the jamb face;

a second wall forming a portion of the first side of the body;

an outside corner formed by the first wall and the second wall at a junction between the jamb face and the first side of the body; and an inside corner located within the adaptation channel;

removing the outside corner of the adaptation channel to expose the inside corner located within the adaptation channel;

wherein removing the outside corner of the adaptation channel comprises removing at least a portion of the first wall and at least a portion of the second wall at the junction between the jamb face and the first side of the body;

and wherein the adaptation channel comprises a closed adaptation channel before removing the outside corner of the adaptation channel.

9. A method of constructing a fenestration unit frame, the method comprising:

providing a first fenestration frame member and a second fenestration frame member, wherein the first fenestration frame member extends along a first frame member length, and wherein the second fenestration frame member extends along a second frame member length, and wherein each of the first fenestration frame member and the second fenestration frame member comprises:

a body extending along the frame member length, the body comprising a jamb face and a sash face, wherein the jamb face is configured to face a jamb defining an edge of a building opening in which a fenestration unit including the fenestration frame member is installed and the sash face is located opposite the jamb face and configured to face a sash of a fenestration unit including the fenestration frame member, the body further comprising a first side and a second side, wherein the first side extends between the jamb face and the sash face and the second side extends between the jamb face and the sash face, and further wherein the first and second sides are located on opposite sides of the frame member such that the first side faces away from the building opening in a first direction and the second side faces away from the building opening in a second direction, wherein the first and second directions face in opposite directions from each other; and an adaptation channel extending along the first side of the body between the jamb face and the sash face, wherein the adaptation channel extends over the frame member length, wherein the adaptation channel comprises:

a first wall forming a portion of the jamb face;

a second wall forming a portion of the first side of the body;

an outside corner formed by the first wall and the second wall at a junction between the jamb face and the first side of the body;

a first interior wall extending along a direction between the first side and the second side of the frame member;

a second interior wall generally perpendicular to the first interior wall, the second interior wall extending along a direction between the sash face and the jamb face of the frame member; and an inside corner formed within the adaptation channel at a junction of the first interior wall and the second interior wall, the inside corner facing away from the sash face and opening towards the jamb face of the frame member;

removing the outside corner of the adaptation channel to expose the inside corner located within the adaptation channel, wherein the adaptation channel comprises a closed adaptation channel before removing the outside corner of the adaptation channel; and attaching the first fenestration frame member to the second fenestration frame member, wherein the first fenestration frame member and the second fenestration frame member form at least a portion of a fenestration unit frame.

10. A method according to claim 9, wherein removing the outside corner of the adaptation channel of each of the first fenestration frame member and the second fenestration frame member comprises removing at least a portion of the first wall and at least a portion of the second wall at the junction between the jamb face and the first side of the body.

11. A method according to claim 10, wherein removing at least a portion of the first wall and at least a portion of the second wall of each of the first fenestration frame member and the second fenestration frame member comprises removing at least a portion of the first wall and at least a portion of the second wall along the entire frame member length of the frame member.

12. A method according to claim 9, wherein the adaptation channel of each of the first fenestration frame member and the second fenestration frame member comprises a generally rectangular inner cross-sectional shape before removing the outside corner of the adaptation channel.

13. A method according to claim 9, wherein each of the first fenestration frame member and the second fenestration frame member further comprises an open trim channel extending along the frame member length adjacent the adaptation channel, wherein the trim channel opens in the first direction and is sized and configured to receive and retain a trim member extending along the frame member length before and after removing at least a portion of the first wall and at least a portion of the second wall.

14. A method according to claim 13, wherein the trim channel is located between the adaptation channel and the sash face of the body of the frame member.

15. A method according to claim 9, wherein each of the first fenestration frame member and the second fenestration frame member further comprises an extension jamb channel extending along the second side of the body between the jamb face and the sash face, wherein the extension jamb channel extends over the frame member length and comprises a sacrificial wall forming a portion of the second side of the body between the jamb face and the sash face, wherein the method further comprises:

removing at least a portion of the sacrificial wall to open the extension jamb channel such that, after removing at least a portion of the sacrificial wall, the extension jamb channel is configured to receive a portion of an extension jamb oriented generally parallel with the jamb defining an edge of a building opening in which a fenestration unit including the frame member is installed.

* * * * *